US009247824B2

(12) United States Patent
Self et al.

(10) Patent No.: US 9,247,824 B2
(45) Date of Patent: Feb. 2, 2016

(54) FURNISHING ELEMENT WITH A CONDITIONING FUNCTION, AND RELATIVE METHOD TO MAKE IT

(75) Inventors: Marco Self, Rivignano (IT); Riccardo Self, Rivignano (IT)

(73) Assignee: SELF SRL, Rivignano (UD) (IT)

( * ) Notice: Subject to any disclaimer, the term of this patent is extended or adjusted under 35 U.S.C. 154(b) by 1330 days.

(21) Appl. No.: 12/700,120

(22) Filed: Feb. 4, 2010

(65) Prior Publication Data

US 2010/0199685 A1 Aug. 12, 2010

(30) Foreign Application Priority Data

Feb. 6, 2009 (IT) ..... UD09A0026

(51) Int. Cl.
*B22C 7/02* (2006.01)
*B22C 9/04* (2006.01)
*A47C 7/74* (2006.01)

(52) U.S. Cl.
CPC . *A47C 7/748* (2013.01); *B22C 7/02* (2013.01); *B22C 9/04* (2013.01)

(58) Field of Classification Search
CPC ..... B22C 7/02; B22C 9/04
USPC ..... 164/34, 35
See application file for complete search history.

(56) References Cited

U.S. PATENT DOCUMENTS 4,285,385 A * 8/1981 Hayashi et al. ..... 164/9
4,526,312 A * 7/1985 Goss et al. ..... 228/157
4,905,750 A * 3/1990 Wolf ..... 164/35

FOREIGN PATENT DOCUMENTS

| | | |
|---|---|---|
| DE | 3818406 | 12/1989 |
| EP | 0188002 | 7/1986 |
| GB | 2172393 | 9/1986 |
| WO | 01/11291 | 2/2001 |

* cited by examiner

*Primary Examiner* — Kevin P Kerns
(74) *Attorney, Agent, or Firm* — Hamre, Schumann, Mueller & Larson, P.C.

(57) ABSTRACT

A furnishing element with a conditioning function, which includes a base structure having a determinate aesthetic and/or functional conformation for furnishing, and one or more conditioning components, able to carry out a heat exchange with the environment to determine the conditioning thereof. The base structure defines at least a radiant surface and is made by lost mold casting. The mold or core used for casting is destroyed at the end of casting. The conditioning components are constrained to the base structure and are suitably shaped to be disposed in proximity to the radiant surface, so that the radiant surface determines a desired radiation, able to condition a room and/or one or more users.

32 Claims, 2 Drawing Sheets

FURNISHING ELEMENT WITH A CONDITIONING FUNCTION, AND RELATIVE METHOD TO MAKE IT

FIELD OF THE INVENTION

The present invention concerns a furnishing element, such as an armchair, a table, a piece of furniture, a bench, a sculpture, an artistic installation or suchlike, both for use in inside environments and also for use in outside environments, also having a conditioning function for the place where it is installed and/or for its user or users. The present invention also concerns the method to make said furnishing element.

BACKGROUND OF THE INVENTION

Furnishing elements that have a function mainly of heating are known: as well as having the normal domestic and/or furnishing functions, they also have the function of heating the place where they are installed and/or its user or users.

These known furnishing elements have conformations imposed mainly by the heating function, while the traditional domestic and/or furnishing functions are neglected.

Indeed, the known techniques for making this type of furnishing element, such as for example pressure casting, shell mold casting, assembly by welding and other, provide to make, directly in the casting or welding step, the components which perform the heating function, such as for example the pipes inside which the heat-carrying fluid flows, or inside which the electric resistances are inserted.

As a result, the aesthetics of the furnishing element and the domestic and/or furnishing function is limited, in that it is constrained and adapted to the possible disposition of the pipes for each determinate process of production used.

An example of said furnishing elements produced by welding are the so-called towel warming radiators, which combine the functions of supporting the towels and those of heating, typical of a radiator.

As a result, the planning and production of said equipment to produce the furnishing elements must be concentrated on the conformation that the heating components must have: the components also determine the aesthetic guide lines, conditioning the possible conformations and domestic and/or furnishing functions themselves.

This necessity therefore limits the possible aesthetic conformations of the heating element, and the type of furnishing element to which the function of heating can be combined.

Therefore, in the state of the art, a furnishing element with a particular design having surfaces with three-dimensional curves, free in space, such as an armchair, an upright piece or other, is difficult to produce, while also guaranteeing an efficient and specific heating function.

Moreover, the known techniques do not allow to produce in advantageously economic terms the pipes conformed so as to be able to follow the development of surfaces with a three-dimensional curve, free in space.

Furthermore, the known techniques for making these furnishing elements are economically justified only for productions on a large scale, that is, in series with a large number of pieces.

This limits the possibility of functional, structural and aesthetic personalization of the furnishing elements, that is, of unitary production, or of a few units of the furnishing elements with heating function.

A furnishing element is known from the German patent application DE-A-38 18406, in this case a chair, made of plastic material provided with an integrated heater.

Movable chairs having integrated electric heating devices are also known form the European patent EP-A-0 188 002, in which the electric heating devices are activated or deactivated electronically depending on the position of the chair.

The British patent application GB-A-2 172 393 refers to a heating device which can be applied to an existing chair in order to actuate the heating of the backrest and of the seat part.

None of these documents teaches how to make the chairs in themselves, nor how to associate the heating device to the chair during the production step of the chair.

Applying the normal casting and molding techniques, the solutions described in these documents have the disadvantages discussed above.

One purpose of the present invention is to make a furnishing element with a conditioning function which is simple and economic to make even in small series, which can have substantially any aesthetic and functional shape, and which guarantees an efficient function of conditioning the room and/or the user/users.

Another purpose of the present invention is to perfect a method which allows to make a furnishing element with a conditioning function, in a simple and economic way, even in small series, substantially of any aesthetic and functional shape, and with an efficient function of conditioning the room and/or the user/users.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, a furnishing element with a conditioning function according to the present invention comprises a base structure having a determinate aesthetic and functional conformation for furnishing.

The furnishing element also comprises one or more conditioning components, such as hydraulic pipes, electric resistances or other, able to carry out a heat exchange with the environment in order to determine the conditioning thereof, to heat and/or cool it.

According to the invention, the base structure defines at least a radiant surface and is made by lost mold casting, in which the mold or core used for the casting is destroyed at the end of casting, to allow the removal of the base structure. The conditioning components are constrained to the base structure and are suitably shaped to be disposed at least in proximity to the radiant surface, so that the latter determines a desired radiation, able to condition a room and/or one or more users.

The making of the base structure by means of lost mold casting allows to configure at will, and on each occasion, the aesthetic and functional conformation of the furnishing element, inasmuch as the mold or core used to define the conformation of the element is destroyed at the end of casting, therefore without constraints on conformation and extraction from the molds and/or on the removal/separation of the molds or cores.

In this way, it is possible to provide one or more radiant surfaces, substantially in any position or of any conformation.

Moreover, this technique of lost mold casting allows to locate the conditioning components as desired, independently of the aesthetic conformation of the base structure, so as to guarantee a radiation that can be used at least by the radiant surface.

This technique allows to make a furnishing element itself provided with a radiant surface at the end of casting, unlike in the known solutions, in which the conditioning components are applied after the molding steps of the furnishing element.

Therefore, unlike the techniques that are typically used, in which the formation of conditioning components is predominant with respect to the aesthetic and functional conformation of the base structure, with the solution according to the present invention it is the conditioning components which are suitably positioned, depending on the conformation of the base structure and/or the position of the radiant surface or surfaces provided.

As a result, with the present invention it is possible to make a furnishing element having substantially any conformation whatsoever and with any design whatsoever, even in reduced series, or only one or a few units, guaranteeing that, at least from the radiant surface or surfaces provided, a usable radiation can be carried out, for the conditioning of the room where they are installed and/or of the user or users.

In this way, furnishing elements with a particular design can be made, having surfaces with three-dimensional curves, free in space, such as armchairs, tables, pieces of furniture, benches, sculptures, upright pieces or others; it is also possible to personalize furnishing elements individually or make them not to standard, with more traditional sizes and conformations such as shelves or others.

Furthermore, unlike what is normally used in heaters made with the known techniques, suitably shaped conditioning components allow to be able to heat more complex, large and curved geometrical areas (ribs, appendices, narrow zones), and to maintain substantially constant the distance between component and radiant surface.

Moreover the present invention, allowing larger areas to be heated, allows to use fluids with lower temperatures and therefore to save energy with the boiler.

The suitably shaped conditioning components, unlike what is normally used, allow to have a constant thickness of the cast and therefore:

- to have a better distribution of the temperature inasmuch as it is more homogenously distributed;
- to have a smaller overall bulk volume of the object;
- to have cheaper raw material.

Furthermore, the suitably shaped conditioning components allow to have a lower volume of heat-carrying fluid in circulation. Given the same heat diffused and the same diffusion time as known radiators, the furnishing elements according to the invention need a smaller quantity of fluid because they have finer sections suitable for the passage of the fluid.

Furthermore, the conditioning components according to the invention allow to predetermine the ideal disposition of the fluid to heat the furnishing element better and in a diversified manner, without constructive constraints.

Another advantage of the present invention is that it is possible to insert conditioning components inside a base structure in the desired manner and quantity, which allows to optimize the heat yield for which the furnishing element is intended.

According to a variant, the conditioning components are incorporated in the thickness of the material that constitutes the base structure.

According to another variant, the conditioning components protrude from an internal surface of the base structure with respect to the radiant surface.

According to another variant, the conditioning components are attached to an internal surface of the base structure, for example by welding, rivets, screws, hooks or other.

According to another variant, the production method comprises a step in which the conditioning components are suitably disposed inside a casting mold, in which the material that constitutes the base structure is able to be cast.

According to another variant, the conditioning components are disposed and maintained inside the casting mold by means of relative positioning supports.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
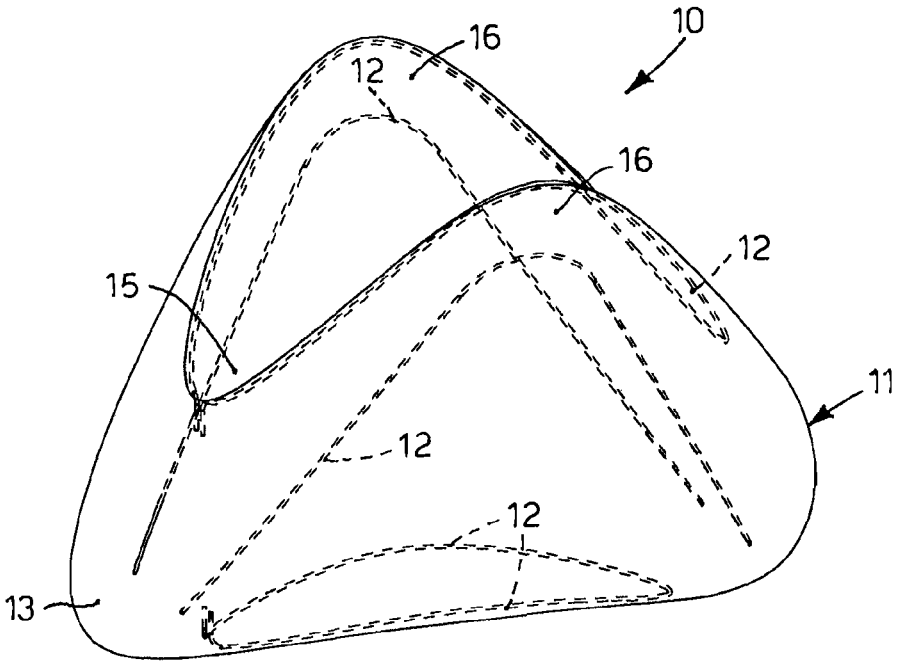
FIG. 1 is a three-dimensional view of a furnishing element according to the present invention.
Figure 2:
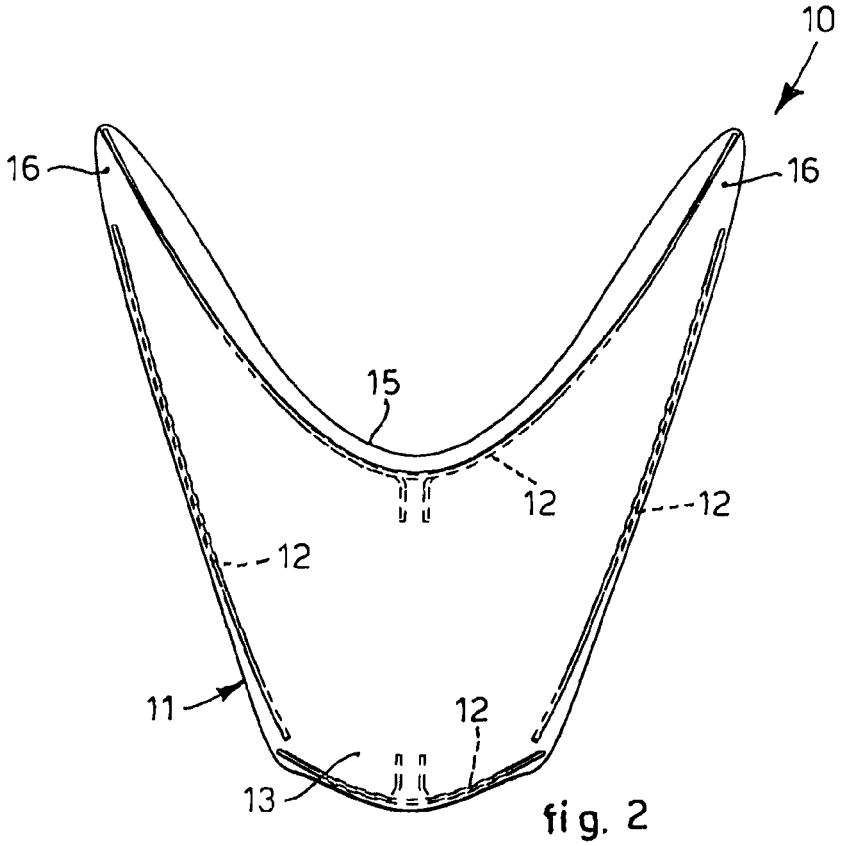
FIG. 2 is a lateral view of a furnishing element according to the present invention.

With reference to the attached drawings, a furnishing element 10 according to the present invention comprises a base structure 11 and a plurality of heating tubes 12 disposed inside the base structure 11.

Hereinafter, merely to give an example, we shall refer specifically to tubes 12 suitable to heat the base structure 11, but it is not excluded that the present invention can equally well be applied to a furnishing element 10 with tubes 12 having a cooling function or other type of conditioning.

In this specific case, the base structure 11 is made of aluminum or one of its alloys, using the technique of lost mold casting in sand, as will be explained in more detail hereafter.

According to a variant, not shown, the base structure 11 can be made using other lost mold casting techniques, such as for example ceramic mold casting, plaster molding or V-process.

According to another variant, not shown, the base structure 11 can be made using the investment casting technique, or other lost pattern casting techniques, such as for example the technique known as lost foam casting.

In the embodiment shown, the base structure 11 is conformed to define an armchair for inside or outside, having a base 13, a seat part 15 and two lateral panels 16.

It is clear that, according to the invention, the base structure 11 can have any desired conformation, defining substantially any furnishing element 10, substantially with any design.

In this specific case, at least the seat part 15 and the internal surfaces of the lateral panels 16, contiguous to the seat part 15, are considered as radiant surfaces of the furnishing element 10, so as to keep heated at least the parts that possibly contact a user.

In this specific case, the external surfaces of the lateral panels 16 and the lower part of the base 13 are also conformed so as to be radiant surfaces of the furnishing element 10, for example to heat the area near the feet.

In this specific case, the furnishing element 10 is hollow, but it is not excluded that it can be made substantially solid.

According to a variant, the base structure 11 can be covered or externally enhanced, for example by painting, veneering, upholstering, padding or other, according to the function and use for which the furnishing element 10 is intended.

The heating tubes 12 are suitably disposed and constrained inside the base structure 11, in correspondence with said radiant surfaces.

The heating tubes 12 are shaped specifically, to follow the conformation, sizes and aesthetic line of the relative radiant surface.

In this specific case, the heating tubes 12 are incorporated in the thickness of the radiant walls of the base structure 11 itself.

According to the variant in which the base structure 11 is solid, the heating tubes 12 are completely incorporated in the material that constitutes the base structure 11.

According to another variant, the heating tubes 12 are incorporated by casting in the radiant walls, but protruding therefrom, toward the inside of the base structure 11.

According to another variant, the heating tubes 12 are constrained to the relative radiant wall of the base structure 11 by welding and/or other attachment means such as rivets, hooks, nails or other, also of the removable type.

Inside the heating tubes 12 a heat-carrying fluid is able to flow, for example hot water.

The heating tubes 12 can be smooth, corrugated, finned, or other possible shapes, depending on the specific construction and/or heating parameters, such as the type of heat-carrying fluid, the thickness of the base structure 11, the quantity of heat to be irradiated or others.

According to a variant, instead of the heating tubes 12 electric resistances are provided, or other heating members, but always and in any case specifically disposed in proximity with the radiant surfaces of the base structure 11, according to the provisions of the present invention.

In the same way, also in the variant solution that provides cooling instead of heating, the tubes 12 are specifically disposed in proximity with the radiant surfaces of the base structure 11.

In this specific case, substantially three groups of pairs of heating tubes 12 are provided, which are disposed, respectively, a first in proximity with the seat part 15 and the internal surfaces of the lateral panels 16, a second in proximity with the external surfaces of the lateral panels 16, and a third in correspondence with the lower part of the base 13.

The three groups of heating tubes 12 are connected to the same line, not shown, delivering and returning the heat-carrying fluid.

According to a variant, a single heating tube 12 is provided, conformed and positioned so as to serve all the radiant surfaces provided.

The method to make a furnishing element 10 according to the present invention is as follows.

Figure 3:
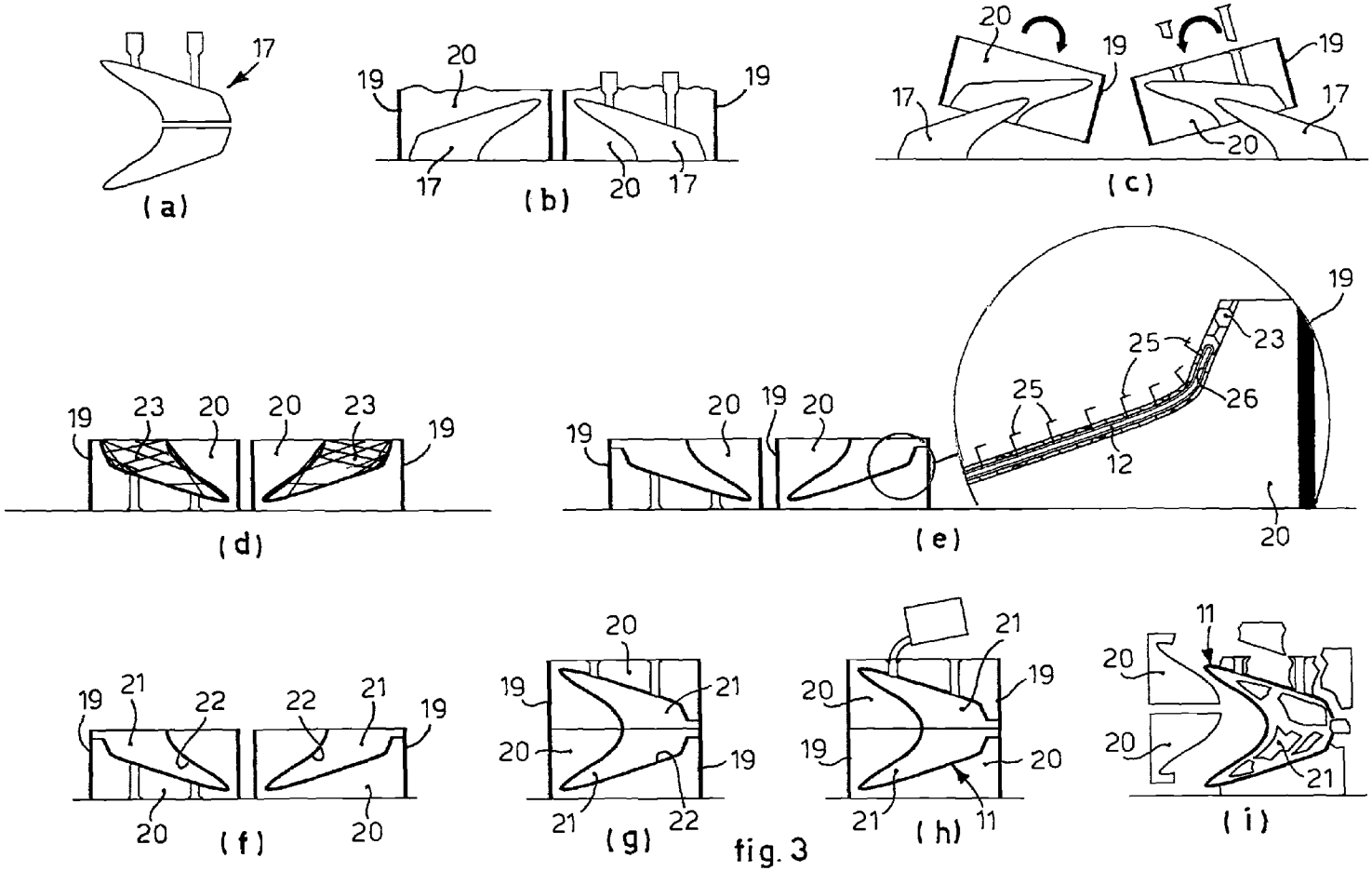
FIG. 3 shows in sequence some operating steps of the method to make the furnishing element in FIG. 1.

With reference to steps a), b), c), d), e), f), g), h) and i), shown schematically in FIG. 3, first of all a pattern 17 is made of suitable material, for example wood, which reproduces aesthetically the shaping of the base structure 11 of the furnishing element 10 to be made.

In this specific case, the pattern 17 can be divided into two or more parts, to facilitate the subsequent molding steps, and is slightly over-sized with respect to the real sizes of the base structure 11, so as to provide for the actual shrinkage of the material that constitutes the base structure 11 during the passage from the liquid to the solid state.

In a subsequent step, a plurality of molding boxes 19 are disposed, in order to make, on the parts of the pattern 17, the sand molds 20 that define the casting space having the external geometry of the base structure 11.

In this step, the parts that make up the pattern 17 are suitably disposed inside relative molding boxes 19, and the latter are individually filled with sand and foundry resins, to form the relative casting molds 20.

Subsequently, once the casting molds 20 have set, the parts of the pattern 17 are removed, and on the surface impressed by the pattern 17 in each casting mold 20 a layer of polystyrene 23 is disposed, which defines the thickness of the base structure 11 to be formed.

In this specific case, suitable housing seatings 26 are made on the layer of polystyrene 23, having a specific development according to the shape and sizes of the radiant surfaces desired. The heating tubes 12 are suitably disposed inside the housing seatings 26.

Relative support hooks 25 are attached to the heating tubes 12.

In this specific case, the support hooks 25 consist of shaped metal tongues, substantially L-shaped. The support hooks 25 are disposed so as to have a free end facing toward the inside of the casting mold 20.

A layer of sand and foundry resins is then laid above the layer of polystyrene 23 and above the heating tubes 12. The layer of sand also incorporates the free ends of the support hooks 25.

Once this last layer of sand has hardened, an internal mold 21 is defined.

Then the polystyrene 23 is removed, so that between the casting mold 20 and the internal mold 21 a casting space 22 is formed, in which the material that constitutes the base structure 11 will be cast.

The support hooks 25, partly incorporated in the internal mold 21, allow to keep the heating tubes 12 in their correct position inside the casting space 22.

Subsequently, the molding boxes 19 are joined together so as to make the casting molds 20 fit together in operation.

Then the material is cast inside the spaces 22, so as to form the base structure 11 with the relative heating tubes 12 incorporated in the thickness.

Once the casting material has cooled inside the spaces 22, the casting 20 and internal molds 21 are destroyed, so as to remove the base structure 11 thus formed and send it to the subsequent steps of finishing and, possibly, enhancement.

It is clear, however, that modifications and/or additions of parts or steps may be made to the furnishing element 10 and relative method to make it as described heretofore, without departing from the field and scope of the present invention.

For example, it comes within the field of the present invention to provide that the heating tubes 12 protrude from the thickness of the walls toward the inside of the base structure 11, instead of being completely incorporated in the thickness.

In this variant, the housing seatings 26 are not made in the polystyrene, but the heating tubes 12 are shaped specifically depending on the shape and sizes of the radiant surfaces and are constrained to the polystyrene 23 by nails.

Advantageously, the heating tubes 12 are covered by a rubber tube that defines the thickness of the metal covering of the heating tube 12 itself. Before casting, the rubber covering tubes of the heating tubes 12 are also removed, as well as the polystyrene 23.

It also comes within the field of the present invention to provide that the casting mold 20 is shaped, instead of using the pattern 17, directly by the removal of material on the sand deposited in the molding box 19.

It also comes within the field of the present invention to provide that the pattern 17 can be made directly with a constant thickness, equal to the base structure 11, substituting the polystyrene 23 and avoiding the step of positioning the latter. In this way, the heating tubes 12 are positioned directly on the thickness of the pattern 17.

It is also clear that, although the present invention has been described with reference to specific examples, a person of skill in the art shall certainly be able to achieve many other equivalent forms of furnishing element with a conditioning function, and relative method to make it, having the characteristics as set forth in the claims and hence all coming within the field of protection defined thereby.

The invention claimed is:

1. A method for the production of a furnishing element with a conditioning function comprising a base structure for defining the furnishing element, and one or more heating and/or cooling components configured to carry out a heat exchange with an environment, the method comprising:

an operating step of making said base structure, the operating step includes defining a radiant surface of said base structure by using a lost mold casting technique selected from the group consisting of sand mold casting, ceramic mold casting, plaster mold casting, V-process, investment casting, lost pattern casting and lost foam casting;

destroying a mold or core used for the lost mold casting technique before or during a removing of the base structure after the operating step;

constraining said one or more heating and/or cooling components to said base structure, wherein said one or more heating and/or cooling components are suitably shaped to be disposed at least in proximity to said radiant surface, so that said radiant surface determines a desired radiation; and disposing said one or more heating and/or cooling components inside said mold, in which a material for said base structure is cast, arranging and maintaining said one or more heating and/or cooling components inside said mold with relative support hooks by attaching said relative support hooks to the one or more heating and/or cooling components, arranging a free end of each of said relative support hooks facing towards an inside of said mold to keep the one or more heating and/or cooling components in a correct position inside a casting space of said mold so that the one or more heating and/or cooling components are maintained inside the furnishing element, said casting space having an external geometry of the base structure and defined by the surfaces of said mold.

2. The method as in claim 1, wherein said lost mold casting is sand mold casting.

3. The method as in claim 1, wherein said lost mold casting is plaster mold casting.

4. The method as in claim 1, wherein the material for the base structure includes aluminum.

5. The method as in claim 1, wherein the material for the base structure includes an aluminum alloy.

6. The method as in claim 1, wherein said lost mold casting technique used is the investment casting.

7. The method as in claim 1, wherein said lost mold casting technique used is the lost foam casting.

8. The method as in claim 1, wherein the casting is defined by the casting mold and by an internal mold.

9. A method for the production of a furnishing element with a conditioning function comprising a base structure for defining the furnishing element, and one or more conditioning components configured to carry out a heat exchange with an environment, the method comprising:

an operating step of making said base structure, the operating step includes defining a radiant surface of said base structure by using a lost mold casting technique selected from the group consisting of sand mold casting, ceramic mold casting, plaster mold casting, V-process, investment casting, lost pattern casting and lost foam casting;

destroying a mold or core used for the lost mold casting technique before or during a removing of the base structure after the operating step;

constraining said one or more conditioning components to said base structure, wherein said one or more conditioning components are suitably shaped to be disposed at least in proximity to said radiant surface, so that said radiant surface determines a desired radiation;

disposing said one or more conditioning components inside said mold, in which a material for said base structure is cast, arranging and maintaining said one or more conditioning components inside said mold with relative supports by attaching said relative supports to said one or more conditioning components, arranging a free end of each of said relative supports facing towards an inside of said mold to keep said one or more conditioning components in a correct position inside a casting space of said mold, said casting space having an external geometry of the base structure and defined by the surfaces of said mold;

i) making a pattern of suitable material which reproduces a shape of the base structure to be made;

ii) making sand molds defining said casting space and said external geometry of the base structure by disposing parts of the pattern inside relative molding boxes, and placing sand in said molding boxes to form said sand molds;

iii) subsequently, once the sand molds are set, the parts of the pattern are removed from the sand molds, and on a surface impressed by the parts of the pattern in each of the sand molds, disposing a layer of a thickness-defining material that defines a thickness of the base structure to be formed;

iv) making housing seatings on the layer of the thickness-defining material, the housing seatings having a development according to shape and size of the radiant surface;

v) disposing one or more of said one or more conditioning components inside the housing seatings;

vi) placing a layer of sand above the layer of the thickness-defining material and above said one or more conditioning components, the layer of sand incorporating the free ends of the relative support, wherein an internal mold is defined by hardened said layer of sand;

vii) then removing the thickness-defining material, and forming a casting space between the sand mold and the internal mold, the casting space is for containing the material for said base structure;

viii) the relative support is at least partly incorporated in the internal mold, and allow maintaining of said one or more conditioning components in a predetermined position inside the casting space;

ix) subsequently, joining together said molding boxes so as to make said mold;

x) casting the material for said base structure inside the casting space, so as to form the base structure with said one or more conditioning components; and xi) once the material for said base structure inside the casting space has cooled, performing the destroying the mold step, which includes destroying said internal mold, and removing the base structure from the mold.

10. The method as in claim 9, wherein step ii) further includes filling said molding boxes with foundry resins; and step vi) further includes laying foundry resins above the layer of the thickness-defining material.

11. The method as in claim 9, wherein said one or more conditioning components protrude from the thickness of the walls toward the inside of the base structure, the housing seatings are not made in the thickness-defining material, and said one or more conditioning components are shaped specifically depending on the shape and sizes of the radiant surfaces and are constrained to the thickness-defining material by nails.

12. The method as in claim 9, further comprising:

covering at least one of said one or more conditioning components with a rubber tube that defines a thickness of material that would cover the at least one of said one or more conditioning components; and before the step x), the rubber tube is removed.

13. The method as in claim 9, wherein said one or more conditioning components are incorporated in the material that constitutes said base structure.

14. The method as in claim 9, wherein said one or more conditioning components are comprised in the thickness of said base structure.

15. The method as in claim 9, wherein said one or more conditioning components protrude from an internal surface of said base structure with respect to said radiant surface.

16. The method as in claim 9, wherein said one or more conditioning components are attached to an internal surface of said base structure.

17. The method as in claim 9, wherein said one or more conditioning components comprise at least one tubular element inside which a heat-carrying fluid is able to flow.

18. The method as in claim 9, wherein said one or more conditioning components has electric resistance.

19. The method as in claim 9, wherein said supports are support hooks.

20. The method as in claim 19, wherein said support hooks are shaped metal tongues, substantially L-shaped.

21. The method as in claim 9, wherein said one or more conditioning components are heating and/or cooling components.

22. The method as in claim 19, wherein said thickness-defining material is polystyrene.

23. A method for the production of a furnishing element with a conditioning function comprising a base structure for defining the furnishing element, and one or more conditioning components configured to carry out a heat exchange with an environment, the method comprising:

an operating step of making said base structure, the operating step includes defining a radiant surface of said base structure by using a lost mold casting technique selected from the group consisting of sand mold casting, ceramic mold casting, plaster mold casting, V-process, investment casting, lost pattern casting and lost foam casting;

destroying a mold or core used for the lost mold casting technique before or during a removing of the base structure after the operating step;

constraining said one or more conditioning components to said base structure, wherein said one or more conditioning components are suitably shaped to be disposed at least in proximity to said radiant surface, so that said radiant surface determines a desired radiation;

disposing said one or more conditioning components inside said mold, in which a material for said base structure is cast, arranging and maintaining said one or more conditioning components inside said mold with relative supports by attaching said relative supports to said one or more conditioning components, arranging a free end of each of said relative supports facing towards an inside of said mold to keep said one or more conditioning components in a correct position inside a casting space of said mold, said casting space having an external geometry of the base structure and defined by the surfaces of said mold;

i) depositing sand in mold boxes;

ii) instead of using a pattern, placing a material in the mold boxes and then removing the material from the mold boxes to form sand molds, wherein said sand molds define said casting space and said external geometry of the base structure;

iii) subsequently, once the sand molds are set, disposing a layer of a thickness-defining material that defines a thickness of the base structure to be formed;

iv) making housing seatings on the layer of the thickness-defining material, the housing seatings having a development according to shape and size of the radiant surface;

v) disposing one or more of said one or more conditioning components inside the housing seatings;

vi) placing a layer of sand above the layer of the thickness-defining material and above said one or more conditioning components, the layer of sand incorporating the free ends of the relative support, wherein an internal mold is defined by hardened said layer of sand;

vii) then removing the thickness-defining material, and forming a casting space between the sand mold and the internal mold, the casting space is for containing the material for said base structure;

viii) the relative support is at least partly incorporated in the internal mold, and allow maintaining of said one or more conditioning components in a predetermined position inside the casting space;

ix) subsequently, joining together said molding boxes so as to make said mold;

x) casting the material for said base structure inside the casting space, so as to form the base structure with said one or more conditioning components; and xi) once the material for said base structure inside the casting space has cooled, performing the destroying the mold step, which includes destroying said internal mold, and removing the base structure from the mold.

24. A method for the production of a furnishing element with a conditioning function comprising a base structure for defining the furnishing element, and one or more conditioning components configured to carry out a heat exchange with an environment, the method comprising:

an operating step of making said base structure, the operating step includes defining a radiant surface of said base structure by using a lost mold casting technique selected from the group consisting of sand mold casting, ceramic mold casting, plaster mold casting, V-process, investment casting, lost pattern casting and lost foam casting;

destroying a mold or core used for the lost mold casting technique before or during a removing of the base structure after the operating step;

constraining said one or more conditioning components to said base structure, wherein said one or more conditioning components are suitably shaped to be disposed at least in proximity to said radiant surface, so that said radiant surface determines a desired radiation;

disposing said one or more conditioning components inside said mold, in which a material for said base structure is cast, arranging and maintaining said one or more conditioning components inside said mold with relative supports by attaching said relative supports to said one or more conditioning components, arranging a free end of each of said relative supports facing towards an inside of said mold to keep said one or more conditioning components in a correct position inside a casting space of said mold, said casting space having an external geometry of the base structure and defined by the surfaces of said mold;

i) making a pattern of suitable material which reproduces a shape and thickness of the base structure to be made;

ii) making sand molds defining said casting space and said external geometry of the base structure by disposing parts of the pattern inside relative molding boxes;

iii) placing sand in said molding boxes to form said sand molds;

iv) making housing seatings on the pattern, the housing seatings having a development according to shape and size of the radiant surface;

v) disposing one or more of said one or more conditioning components inside the housing seatings;

vi) placing a layer of sand above the pattern and above said one or more conditioning components, the layer of sand incorporating the free ends of the relative support, wherein an internal mold is defined by hardened said layer of sand;

vii) then removing the pattern, and forming a casting space between the sand mold and the internal mold, the casting space is for containing the material for said base structure;

viii) the relative support is at least partly incorporated in the internal mold, and allow maintaining of said one or more conditioning components in a predetermined position inside the casting space;

ix) subsequently, joining together said molding boxes so as to make said mold;

x) casting the material for said base structure inside the casting space, so as to form the base structure with said one or more conditioning components; and xi) once the material for said base structure inside the casting space has cooled, performing the destroying the mold step, which includes destroying said internal mold, and removing the base structure from the mold.

25. A method for the production of a furnishing element with a conditioning function comprising a base structure for defining the furnishing element, and one or more heating and/or cooling components configured to carry out a heat exchange with an environment, the method comprising:

an operating step of making said base structure, the operating step includes defining a radiant surface of said base structure by using a lost mold casting technique selected from the group consisting of sand mold casting, ceramic mold casting, plaster mold casting, V-process, investment casting, lost pattern casting and lost foam casting;

destroying a mold or core used for the lost mold casting technique before or during a removing of the base structure after the operating step;

constraining said one or more heating and/or cooling components to said base structure, wherein said one or more heating and/or cooling components are suitably shaped to be disposed at least in proximity to said radiant surface, so that said radiant surface determines a desired radiation; and disposing said one or more heating and/or cooling components inside said mold, in which a material for said base structure is cast, arranging and maintaining said one or more heating and/or cooling components inside said mold with relative supports by attaching said relative supports to the one or more heating and/or cooling components, arranging a free end of each of said relative supports facing towards an inside of said mold to keep the one or more heating and/or cooling components in a correct position inside a casting space of said mold so that the one or more heating and/or cooling components are maintained inside the furnishing element, said casting space having an external geometry of the base structure and defined by the surfaces of said mold, and wherein the relative supports are partly incorporated in said mold.

26. The method as in claim 25, wherein said lost mold casting is sand mold casting.

27. The method as in claim 25, wherein said lost mold casting is plaster mold casting.

28. The method as in claim 25, wherein the material for the base structure includes aluminum.

29. The method as in claim 25, wherein the material for the base structure includes an aluminum alloy.

30. The method as in claim 25, wherein said lost mold casting technique used is the investment casting.

31. The method as in claim 25, wherein said lost mold casting technique used is the lost foam casting.

32. The method as in claim 25, wherein the casting is defined by the casting mold and by an internal mold.

* * * * *